United States Patent [19]

Knickerbocker

[11] 4,194,256

[45] Mar. 25, 1980

[54] WIRE INSTALLING TOOL

[75] Inventor: Robert H. Knickerbocker, Cheshire, Conn.

[73] Assignee: The Siemon Company, Watertown, Conn.

[21] Appl. No.: 883,887

[22] Filed: Mar. 6, 1978

[51] Int. Cl.[2] ..... H01R 43/04

[52] U.S. Cl. ..... 7/107; 29/566.4; 29/751; 29/758; 29/838; 29/867

[58] Field of Search ..... 29/751, 750, 752, 758, 29/628, 566.4; 7/107, 158

[56] References Cited

U.S. PATENT DOCUMENTS

| | | | |
|---|---|---|---|
| 3,604,092 | 9/1971 | Knickerbocker | 29/750 |
| 3,621,899 | 11/1971 | Hula | 30/342 X |
| 3,708,852 | 1/1973 | Mason | 29/566.4 X |
| 3,896,534 | 7/1975 | Kaufman et al. | 29/566.4 |

*Primary Examiner*—Carl E. Hall

[57] ABSTRACT

A wire installing tool for inserting wire into a multifingered electrical connector comprising a handle containing a reversible elongated stem having recesses on both ends; the recesses being sized differently in depth to adapt to electrical connectors having various thicknesses, and a disposable blade releasably mounted on the stem and aligned with the recess to form a cavity which is bounded on three sides by the stem and on the fourth side by the blade, the depth of the cavity dependent upon which end of the stem is aligned with the blade. One end of the blade has a two-sided edge, the outer side shaped at an optimum shear angle for shearing wire to be inserted in the electrical connector, and the inner side of the edge being shaped to allow for a wire tail to protrude a predetermined distance from the electrical connector. The other end of the blade has a blunt end rather than a cutting edge, the blunt end being used to install wire on an electrical connector without cutting the wire.

7 Claims, 9 Drawing Figures

WIRE INSTALLING TOOL

BACKGROUND OF THE INVENTION (1) Field of the Invention

The present invention relates to wire installing tools for connecting electric wires to an electrical connector.

(2) Description of the Prior Art

It is known to use a wire installing tool to connect wire to conventional electrical connectors. These electrical connectors, in general, comprise at least two adjacent fingers extending from a base.

When an insulated electrical wire is inserted and pushed downwardly between the fingers, the insulation is scraped or cut away making the desired contact between the electrical connector and the wire. It is known to insert the insulated wire in the electrical connector and sever one end of the wire by the use of a wire installing tool having a blade including a cutting edge on one side. Although this type of blade is capable of severing the insulated wire, it often cuts the wire at a point close to the electrical connector resulting in a connection that is secured only by the metal core of the insulated wire. Insulated wires secured in this manner may easily separate from the connector from tension or vibration on the wire.

Another type of tool is disclosed in U.S. Pat. No. 3,604,092 which discloses a tool for inserting electrical wires into electrical connectors. Although the tool disclosed therein is adjustable so that cavities of two different widths may be provided, this patent does not disclose the use of a blade to cut the wires.

SUMMARY OF THE PRESENT INVENTION

The present invention provides a wire installing tool including an elongated reversible stem having recesses on both ends thereof, one end of the stem being available for installation of wire into an electrical connector and the other end being disposed within a handle during use of the tool. A replaceable blade may be attached to either end of the stem to provide cavities of two depths depending on which end of the stem is available for installation of wire. The handle includes a storage space for spare stem and blade sets.

In the preferred embodiment of the invention one end of the blade has an edge having two sides, one side of the edge being the optimum cutting angle for severing the wire to be inserted in the electrical connector, and the other side of the edge allowing for the wire to be cut at a predetermined distance from the electrical connector and kinked to provide for securement of the wire in the electrical connector. The other end of the blade has a blunt end rather than a cutting edge, and the blunt end is used to install wire on an electrical connector without cutting the wire.

In another embodiment of the invention, the ends of the blade and the stem include angled portions which allow for installation of ceramic diodes or resistors without damage to the ceramic diodes or resistors.

DETAILED DESCRIPTION OF THE INVENTION

Figure 2:
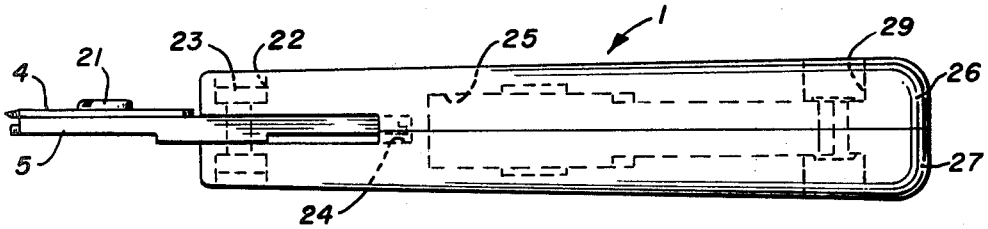
FIG. 2 shows a side elevation view of the wire installing tool of FIG. 1.
Figure 3:
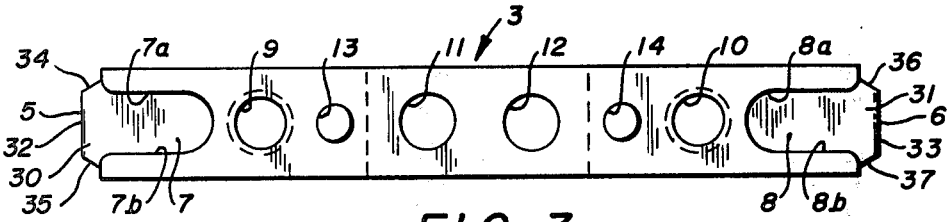
FIG. 3 shows an enlarged elevational view of the top of the stem of the wire installing tool shown in FIG. 1.
Figure 4:
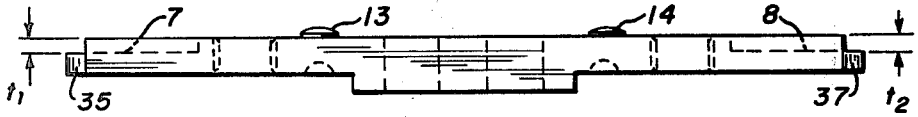
FIG. 4 shows an enlarged side elevational view of the stem of the wire installing tool of FIG. 1.

Referring to FIGS. 1–6, wire installing tool 1 comprises handle 2, stem 3 and blade 4. Stem 3 comprises an elongated, generally rectangular plate having ends 5 and 6. Ends 5 and 6 of stem 3 include recesses 7 and 8. These recesses are of less width than stem 3 and are bounded on the bottom and both sides by the body of stem 3. As shown in FIG. 4, recess 7 has a depth of $t_1$ and recess 8 has a depth of $t_2$, the depth of recess 8 being greater than the depth of recess 7 in order to secure wires to electrical connectors having thicknesses of $t_1$ and $t_2$. Walls 7*a* and 7*b* (and also 8*a* and 8*b*) are straight sided throughout their depth and parallel to each other along most of their length, with the spacing between the walls held to extremely close tolerance (on the order of 0.001″). This construction insures positive connection between wire and connectors for various gage wires. Threaded holes 9 and 10 provide for the attachment of blade 4 to stem 3 by blade screw 21 and holes 11 and 12 allow for the attachment of stem 3 to handle 2 by nut-bolt combination 23. On the surface of stem 3 are protrusions 13 and 14 which fit within detents 17 and 18 on blade 4 to allow blade 4 to be mounted fixedly to stem 3. Blade 4 includes hole 16 through which a screw may fit to attach blade 4 to stem 3.

Figure 6:
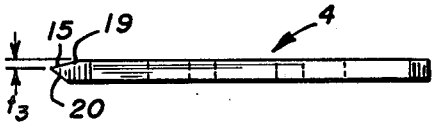
FIG. 6 shows a side elevational view of the blade of the wire installing tool of FIG. 1.

Referring to FIG. 6, it can be seen that blade 4 includes edge 15 which has inner and outer sides 19 and 20. Outer side 20 is cut in a manner to allow optimal shearing of the wire and has an angle of about 34° with the surface of the blade. Inner side 19 of edge 15 is cut in order to provide a gap $t_3$, the utility of which will be described hereinafter. The other end of the blade is terminated in blunt end portion 44, which may be rotated and secured in place when tool 1 is used to install but not to cut wires. Blade 6 is marked to identify the side which faces outward from stem 3.

Figure 1:
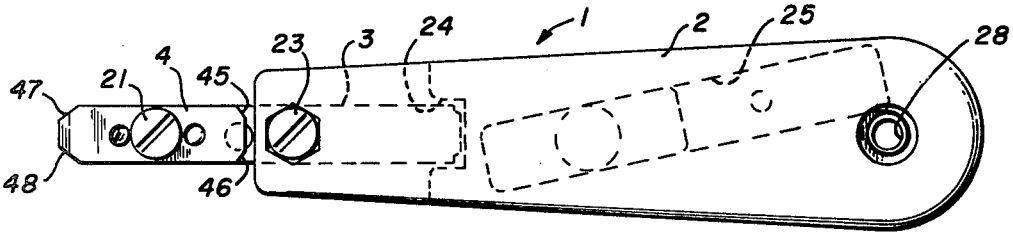
FIG. 1 shows an elevational view of the front of a wire installing tool.

As shown in FIGS. 1 and 2, blade 4 is attached by blade screw 21 to end 5 of stem 3. Blade 4 is releasably mounted on stem 3 and aligned with recess 7 to form a cavity which is bounded on three sides by stem 3 and on the fourth side by blade 4. Handle 2 includes hole 22 that corresponds with hole 12 when the stem is placed within handle 2 so that nut-bolt combination 23 can secure stem 3 within handle 2. End 6 of stem 3 is located in recess 24 within handle 2 to prevent rotation about nut-bolt combination 23 during use of tool. Handle 2 includes storage space 25 in which two additional stem and blade sets may be stored for desired use. It should be understood that with the storage capabilities of the handle, the wire installing tool of the present invention is capable of use with up to six electrical connectors each having a different thickness. Handle 2 comprises two prefabricated plastic portions 26 and 27 which are held together by rivet 28 disposed through rivet hole 29 in the end portions of prefabricated plastic portions 26 and 27. Handle portions 26 and 27 are color coded so that the installer can identify the cutting side of the tool (which is always adjacent to one color of the handle). When nut-bolt combination 23 is removed, portion 26 of handle 2 can be rotated away from portion 27 of handle 2 to provide access to storage space 25.

Figure 5:
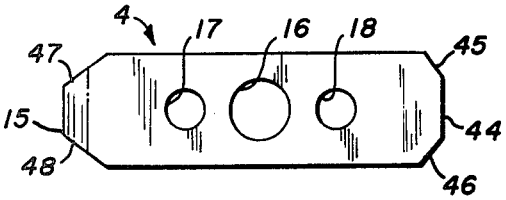
FIG. 5 shows a top elevational enlarged view of the blade of the wire installing tool of FIG. 1.

As shown in FIGS. 3 and 4, anvils 30 and 31 extend respectively from ends 5 and 6 to provide bearing surfaces 32 and 33 which bear against wire inserted in an electrical connector. Bearing surface 32 is cut away on both sides by angled portions 34 and 35. Angled portions 34 and 35 allow for installation of wires extending from ceramic diodes or resistors without damage by the wire installing tool to the ceramic diodes or resistors. Bearing surface 33 is similarly cut away by angled portions 36 and 37. As shown in FIGS. 1 and 5, blunt end portion 44 of blade 4 is cut away by angled portions 45 and 46 and edge 15 of blade 4 is cut away by angled portions 47 and 48 to similarly allow for installation of wires extending from ceramic diodes or resistors without damage.

Figure 7:
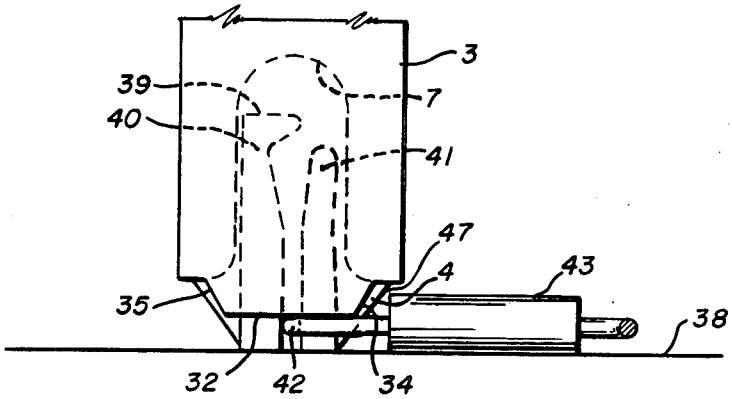
FIG. 7 shows an enlarged bottom view of the tool of FIG. 1 being used to insert a diode or a resistor into an electrical connector.

Referring to FIG. 7 conventional circuit board or mounting base 38 has conventional electrical connector 39 extending therefrom. Electrical connector 39 includes two fingers 40 and 41 between which uninsulated wire 42 has been pressed and secured into place. A ceramic diode or a resistor 43 may be secured between electrical connector 39 and another electrical connector (not shown). Angled portion 34 on anvil 30 and angled portion 47 on edge 15 allow for the installation of wires extending from diodes or resistors 43 without damage to the ceramic portions of diode or resistor 43. The cavity formed by recess 7 of stem and blade 4 is fit over electrical connector 39 and has a width so as to press securely and evenly against both fingers 40 and 41 to allow for securement of wire 42.

Figure 8:
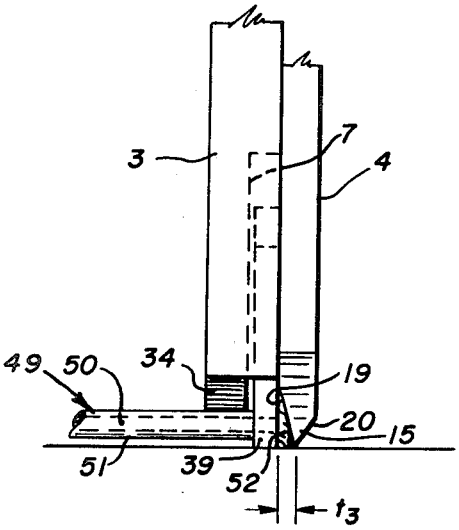
FIG. 8 shows an enlarged side view of the tool of FIG. 1 being used to insert an insulated wire into an electrical connector.
Figure 9:
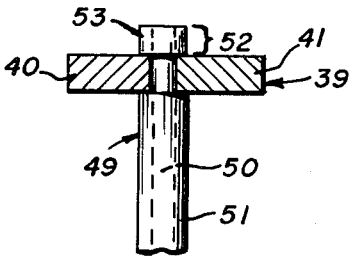
FIG. 9 shows an insulated wire secured into an electrical connector.

FIGS. 8 and 9 demonstrate the advantages of edge 15 having two sides 19 and 20 when installing insulated wire. The angle of inner side 19 allows for edge 15 of blade 4 to be spaced from electrical connector 39 a predetermined distance of $t_3$. This allows for the shearing of insulated wire 49 a distance of about $t_3$ away from electrical connector 39 and also allows for a kink to form in terminal portion 52 of wire 42, which protrudes past the connector on the cut side of the wire and provides one form of positive locking of wire 49 to electrical connector 39. As shown in FIG. 9, insulated wire 49 is secured between fingers 40 and 41 of electrical connector 39. Insulated wire includes metal core 50 surrounded by insulating material 51 such as plastic. The insulating material has been crushed or stripped away where wire 49 is grasped between fingers 40 and 41. Terminal portion 52 of wire 49 includes retaining portion 53 of insulating material 51 which is larger in diameter than the gap between fingers 40 and 41 and serves as a secured form of positive lock to prevent wire 49 from being removed easily from electrical connector 39.

It should be understood that when used with uninsulated wire, as shown in FIG. 7, uninsulated wire 42 is sheared a distance of about $t_3$ away from connector 39 and a kink is formed in the terminal portion of wire 42 to provide firm attachment of wire 42 within connector 39.

While preferred embodiments have been shown and described, various modifications and substitutions may be made thereto without departing from the spirit and scope of the invention. Accordingly, it is to be understood that the present invention has been described by way of illustration and not limitation.

I claim:

1. In a wire installing tool of the type having a handle, a stem having first and second reversible ends, said stem being reversibly mounted on and extending from the handle, and blade means mounted on the stem, the improvement comprising:

a first recess on said first end of said stem;

a second recess on said second end of said stem;

the depth of one of said recesses being greater than the other;

mounting means on the first and second ends of said stem for receiving said blade means;

said blade means being shorter than said stem means and being reversibly mounted on the end of said stem extending from the handle, said blade means when mounted on said first end of said stem cooperating with said first end to form a first cavity of first predetermined depth for installing wire on an electrical connector of first thickness and when mounted on said second end of said stem cooperating with said second end to form a second cavity of second predetermined depth for installing wire on an electrical connector of second thickness; and said blade means having a first end with a cutting edge for shearing wire upon mounting on an electrical connector, and said blade means having a second blunt end for mounting wire on an electrical connector without shearing.

2. A wire installing tool as in claim 1 wherein said cutting edge of said blade means includes:

a first surface spaced from said stem and inclined at a first predetermined angle to form a cutting edge;

a second surface adjacent to said stem inclined at a second predetermined angle to form a space between the cutting edge and the stem; and said first angle being different than said second angle.

3. A wire installing tool as in claim 2 wherein:

said first predetermined angle is selected to achieve optimal shearing of the wire.

4. A wire installing tool as in claim 2 wherein:

said first predetermined angle is about 34° with respect to the surface of said blade means.

5. A wire installing tool as in claim 1 wherein:

each of said ends of said stem has an anvil to bear against wire installed in an electrical connector, each of said anvils being cut away on both sides to provide inclined sides diverging outwardly from a narrow end of the stem to the body of the stem; and each of said first and second ends of said blade means is cut away on both sides to provide inclined sides diverging outwardly from a narrow end of the blade means to the body of the blade means.

6. A wire installing tool according to claim 1 wherein said handle includes storage space for at least one additional stem and blade set.

7. A wire installing tool according to claim 6 wherein said handle includes two portions which are held together at one end by a means which allows the portions to be rotated apart to provide access to the storage space.

* * * * *